US005493092A

United States Patent [19]

Rowe

[11] Patent Number: 5,493,092

[45] Date of Patent: Feb. 20, 1996

[54] SHIELD FOR A LINE SIDE OF A CIRCUIT BREAKER FOR SUPPORTING CABLE AND DEFLECTING IONIZED GASES

[75] Inventor: Neal E. Rowe, Asheville, N.C.

[73] Assignee: Eaton Corporation, Cleveland, Ohio

[21] Appl. No.: 321,702

[22] Filed: Oct. 12, 1994

[51] Int. Cl.[6] ..... H01H 33/04; H01H 9/30

[52] U.S. Cl. ..... 218/156; 200/304; 200/306; 218/157

[58] Field of Search ..... 200/144 R, 304, 200/305, 306; 335/201, 202; 218/1, 149, 150, 151, 155, 156, 157, 158

[56] References Cited

U.S. PATENT DOCUMENTS

| | | | |
|---|---|---|---|
| 2,225,791 | 12/1940 | Nau et al. | 200/306 |
| 2,727,965 | 12/1955 | Toth et al. | 200/304 |
| 2,863,969 | 12/1958 | Edmunds | 200/144 R |
| 4,620,076 | 10/1986 | Mrenna et al. | 200/304 |
| 4,638,277 | 1/1987 | Thomas et al. | 335/190 |
| 4,639,564 | 1/1987 | Grunert et al. | 200/144 R |
| 4,650,940 | 3/1987 | Grunert et al. | 200/144 R |
| 5,084,689 | 1/1992 | Morgan et al. | 335/202 |
| 5,304,761 | 4/1994 | Rosen et al. | 200/144 R |
| 5,317,117 | 5/1994 | Bruski et al. | 200/144 R |

*Primary Examiner*—J. R. Scott
*Attorney, Agent, or Firm*—Martin J. Moran

[57] ABSTRACT

A shield structure on the line side of a circuit breaker has several adjacent channels for carrying ionized gases and cables electrically connected to a line terminal assembly. The shield structure has a main portion and a stepped portion which directs the channels and, thus, the cables and the ionized gases to the rear of the circuit breaker. The main portion has sidewalls, a top wall, and inner walls which form compartments, and which communicate with the walls of the circuit breaker to enclose a pole unit for each of the line terminal assemblies. In each compartment of the main portion of the shield structure, a hanging barrier is disposed between the entrances to the channels for the cables and those for the ionized gases, and cooperates with a flexible member associated with the line terminal assembly to separate the vented ionized gases from the cable line connection, and a hanging lug with an aperture, abuts a tube leading into the line terminal assembly to contain the ionized gases in an area between the barrier and the lug to direct the flow of ionized gases into the channels and to separate the gases from the cable connection. A second embodiment of the present invention has transverse channels for receiving the cables in the top of the circuit breaker.

24 Claims, 7 Drawing Sheets

SHIELD FOR A LINE SIDE OF A CIRCUIT BREAKER FOR SUPPORTING CABLE AND DEFLECTING IONIZED GASES

BACKGROUND OF THE INVENTION

1. Field of the Invention

This invention relates to a circuit breaker, and, more particularly, to a shield structure which interlocks with a line side of the circuit breaker and which carries and directs the electrical cables and the ionized gases away from the circuit breaker.

2. Description of the Prior Art

The demands of the electrical industry are for smaller electrical power components, which include a circuit breaker, particularly a circuit breaker used as a motor circuit protector (MCP) or an overcurrent protective device of a motor controller. When a circuit breaker is reduced in physical size, but not in electrical performance and capacity, several problems arise.

For instance, for a circuit breaker previously having a frame size of about 4 inches wide and 6 inches high, and a rated current of 63 amps, a specific installation may require the frame size to be reduced to about 3 inches wide and 4.75 inches high for the same current value. This latter frame size, in turn, requires a smaller case size for the circuit breaker, and the smaller case size results in a smaller arc chamber compared to that of the previous circuit breaker frame size of 4 inches wide and 6 inches high.

When a current interruption occurs in this smaller arc chamber, the volume of the ionized gases formed by the electrical arc created between the electrical contacts upon separation is not reduced, but is the same volume as that formed in the larger circuit breaker frame size. In the reduced frame size, this volume of gases is forced to be vented through reduced openings in the molded case, which may result in an increase in gas pressure. If the gas pressure is increased, care must be taken so that the line terminals do not restrike phase to phase since it would be the tendency for the ionized gases to be trapped in the top of the circuit breaker on its line side. That is, when a certain type of circuit breaker is a motor circuit protector or an over-current protector, installed in a motor control center where a steel barrier member divides a lower combination motor controller from the one directly above it, the steel barrier member tends to trap the ionized gases on the top of the lower circuit breaker on its line side, thereby allowing the line terminals to restrike.

One way in which to prevent the ionized gases from being trapped between the steel barrier member and the top of the circuit breaker on its line side, is to increase the space between the top of the circuit breaker and the steel barrier. However, this solution may be unacceptable since it goes in a direction opposite to miniaturization of the electrical power components, and the assemblies which they fit into.

There remains, therefore, a need in the art to decrease the size of a circuit breaker and lessening or minimizing the pressure of the ionized gases by reducing the volume of the ionized gases in the line side of the circuit breaker.

There also remains a need in the art to decrease the size of a circuit breaker without increasing the likelihood of a secondary are being struck between the line terminals as a result of the higher gas pressure created by a current interruption.

SUMMARY OF THE INVENTION

The present invention provides a shield structure which interlocks with a circuit breaker on its line side that obviates or at least ameliorates the aforementioned shortcomings associated with a smaller frame size where the electrical capacity and the internal components of the circuit breaker remain the same as those for a larger frame size for a circuit breaker.

Briefly, this shield structure has a main portion and a stepped portion communicating with and overhanging the main portion. These portions contain channels for carrying ionized gases and supporting cables for an electrical connection to a line terminal. The main portion and the stepped portion are arranged relative to each other such as to direct the cables and the ionized gases to the rear of the circuit breaker, or to direct the cables to the top of the circuit breaker and the ionized gases to the rear of the circuit breaker. The main portion has sidewalls, a top wall, a rear wall, and inner walls which form compartments, and which walls overlap with and correspond to those of the circuit breaker to enclose a pole or unit for each of the line terminal assemblies. In each compartment of the main portion, a hanging barrier member is disposed between the entrance to a channel for the cable and the entrance to the channels for the ionized gases, and cooperates with a flexible member associated with a line terminal assembly to separate the vented ionized gases from the cable line connection, and a depending lug with an aperture abuts a tube leading into the line terminal assembly to resist the escape of ionized gases out of the top of the circuit breaker on its line side.

It is, therefore, an object of the present invention to provide a means which allows the reduction in the size of the frame for a circuit breaker having the same electrical capacity and the same size of internal components as previously built circuit breakers, without an increase in the pressure and volume of the ionized gases in a line side thereof.

It is a further object of the present invention to provide a means for isolating the line terminals from the ionized gases and causing the ionized gases flowing to the line side of a circuit breaker to turn and be vented to the rear of the circuit breaker.

A further object of the present invention is to provide a device for a circuit breaker which: 1) controls the venting of ionized gases by directing the flow of gases away from the ground plane and to the rear of circuit breaker where there is room for the gases to expand and dissipate; 2) isolates the line terminals from each other so as to resist line to line faults during the arc interruption process; 3) allows the cables providing power to the circuit breaker to enter the line terminals either from the top or from the rear of the circuit breaker; and 4) allows the application of a circuit breaker with a smaller frame size into confined spaces of a motor control center particularly when the circuit breaker is a motor circuit protector for a motor controller.

These and other objects and advantages of the present invention will become more readily apparent and understood from the following description of the invention on reference to the illustrations appended herein.

DESCRIPTION OF PREFERRED EMBODIMENTS

The present invention may generally be used in conjunction with a circuit breaker, which may be a motor circuit protector (MCP), and which will be described as applied to a combination motor controller.

Figure 1:
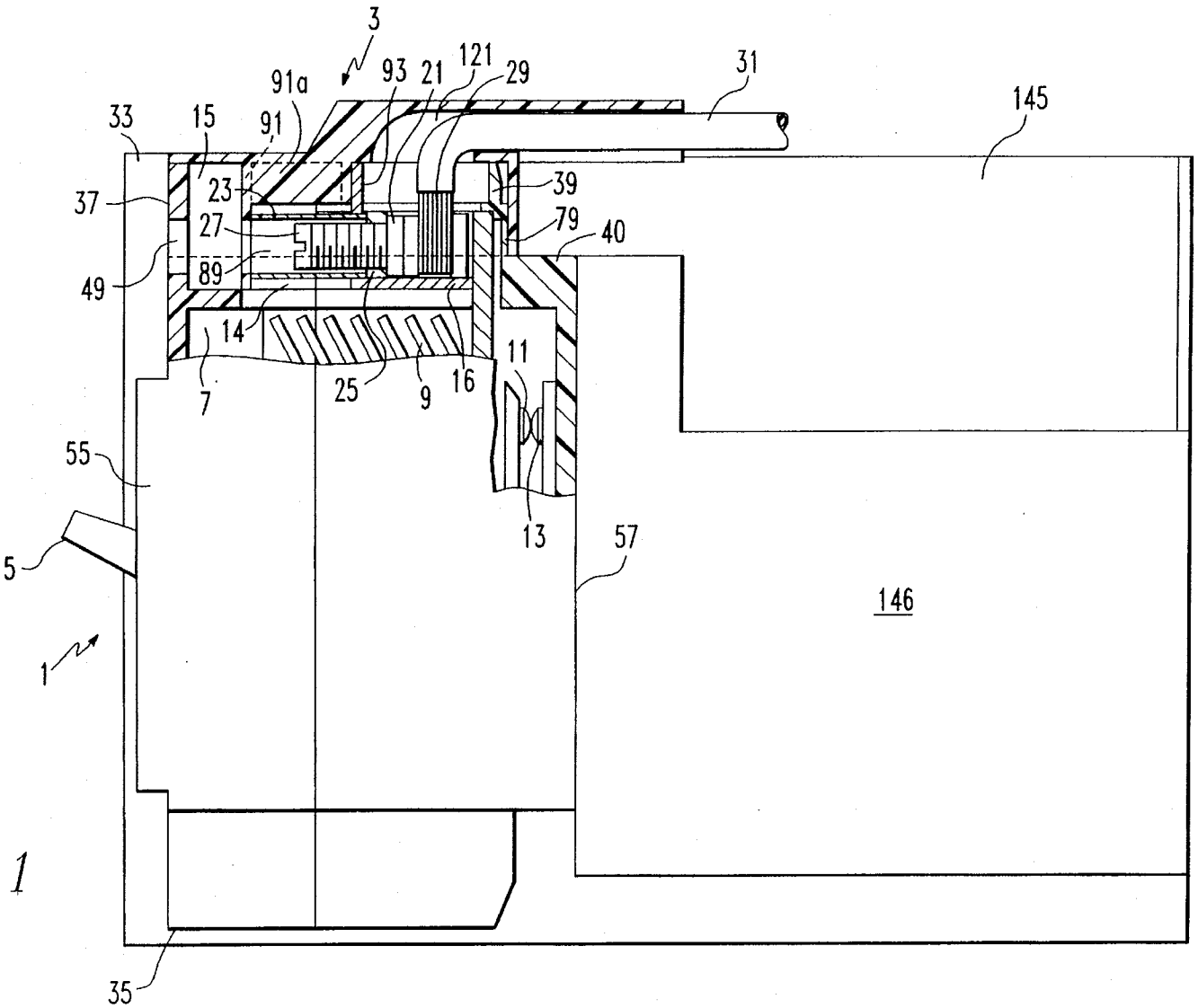
FIG. 1 is a side elevational view, partly cross-sectional view, of a first embodiment of a shield structure of the present invention, which shield structure is mounted on a circuit breaker on its line side in a motor control center.
Figure 2:
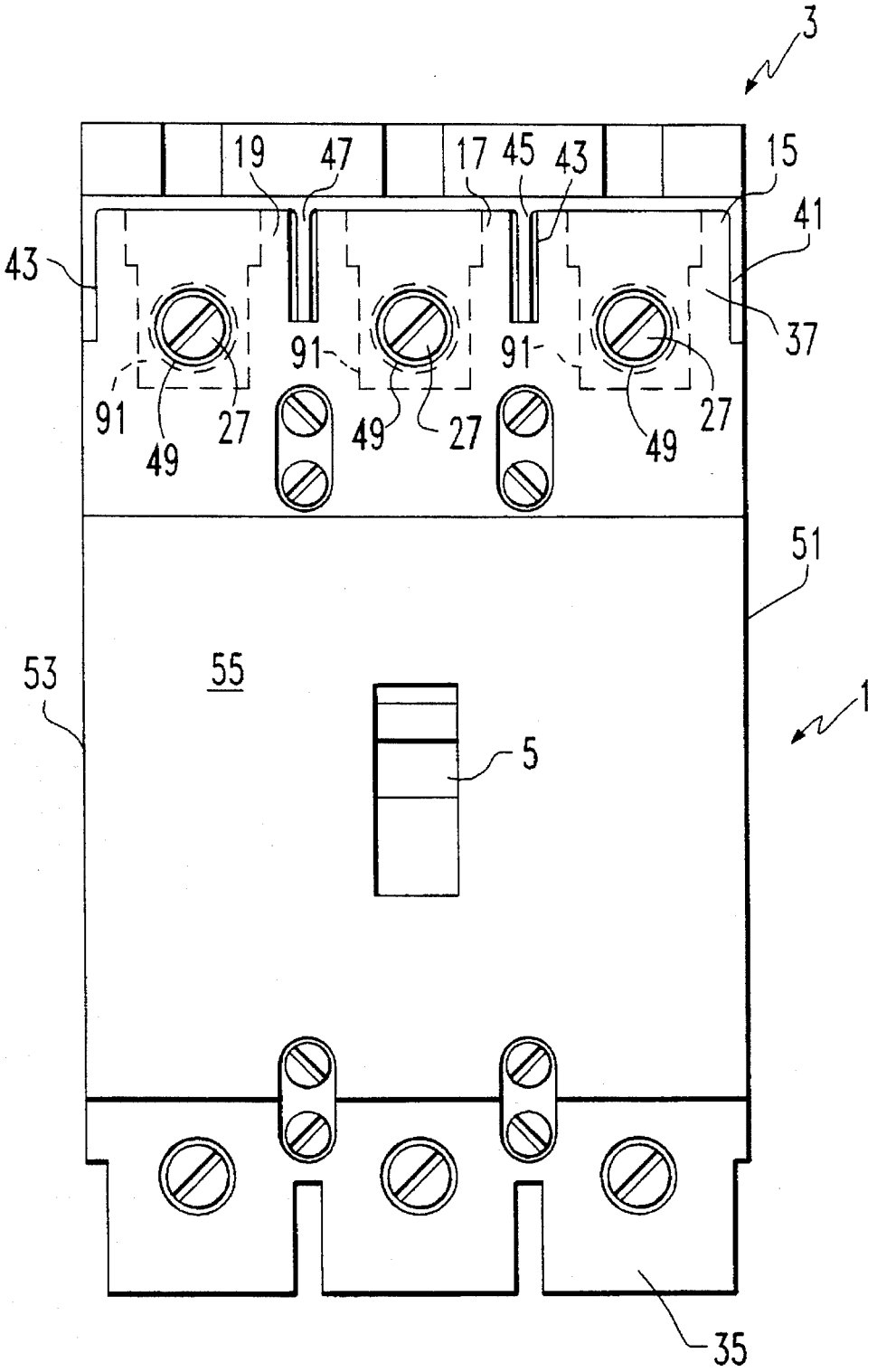
FIG. 2 is a front elevational view illustrating the shield structure of FIG. 1 and the manner in which it is mounted on the circuit breaker.

Referring first to FIGS. 1 and 2, there is shown a circuit breaker 1, and a shield structure 3 of the present invention. The principal, construction, and operation of circuit breaker 1 may be similar to that of U.S. Pat. No. 4,638,277 issuing on Jan. 20, 1987, and which is incorporated herein by reference. Circuit breaker 1 may be a GMCP where "G" represents a frame size measuring 3.00 inches wide by 4.75 inches high, and "MCP" represents a motor circuit protector. Circuit breaker 1 is a three pole, instantaneous motor circuit protector which may have an electrical current rating of about 63 amps.

As shown in FIG. 1, circuit breaker 1 has an arc chamber 7 with arc extinguishers, one of which is indicated at number 9, and a fixed contact 11 and a movable contact 13 similar to that shown in the above U.S. Pat. No. 4,638,277. Circuit breaker 1 is manually operated by way of a handle 5 in a manner well-known in the art. Also shown in FIGS. 1 and 2 are terminal pole units 15, 17 and 19, each containing a terminal assembly 21, a plastic tube 23 attached at one end of terminal assembly 21, and a flexible member 25 mounted around tube 23, as particularly shown in FIG. 1. Tube 23 receives and protects a screw 27 which is part of the terminal assembly 21 for securing the wires 29 of a cable 31 for a cable line connection with terminal assembly 21. Opposite to the line side 33 of breaker 1 is a load side indicated by numeral 35 which is well-known to those skilled in the art.

When a current interruption occurs in circuit breaker 1 of FIGS. 1 and 2, the main electrical contacts 11 and 13 are separated, and current, still being conducted between the separating contacts, form an electric arc therebetween, and the arc extinguishers 9 operate to extinguish this arc. In the process, ionized gases are formed, and exit above the arc extinguishers 9 in the area designated by numeral 14 on the line side 33 of breaker 1.

In this area 14, there is a wall 16, which along with flexible member 25 substantially contains the ionized gases to the left of wall 16, when referring to FIG. 1, more about which will be discussed hereinbelow.

FIG. 2, in particular, shows circuit breaker 1 as having three phase or pole units 15, 17, and 19, each of which is similar in construction to pole unit 15 discussed with particular reference to FIG. 1.

Each pole unit 15, 17, and 19 consists of a separate compartment having a front wall 37, an endwall 39, and sidewalls 41 and 43. The sidewalls 41 and 43 of pole units 15 and 17, and of pole units 17 and 19 form a longitudinal slot 45 and 47, respectively, between pole units 15, 17, and 19. Front wall 37 of each pole unit 15, 17, and 19 contains an aperture 49 which is in line with tube 23 (FIG. 1) for access to screw 27 connected to its respective terminal assembly 21.

Sidewall 41 of pole unit 15 and sidewall 43 of pole unit 19, as shown in FIG. 2, are located slightly inwardly of the main walls 51 and 53 of circuit breaker 1. Front wall 37 of each pole unit 15, 17, and 19 is flushed with the front wall 55 of the main body of circuit breaker 1 with the rear wall 39 of each pole unit 15, 17, and 19 being formed inwardly of rear wall 57 of the main body of breaker 1.

The circuit breaker 1, discussed hereinabove, is constructed and operated in a manner well-known in the art. The shield structure 3 of the present invention, as shown in FIG. 2, interlocks with circuit breaker 1 on its line side 33, and a first embodiment for the present invention will now be described and discussed with particular reference to FIGS. 2, 3, 4, 5, 6, 7, 8, and 9.

Figure 3:
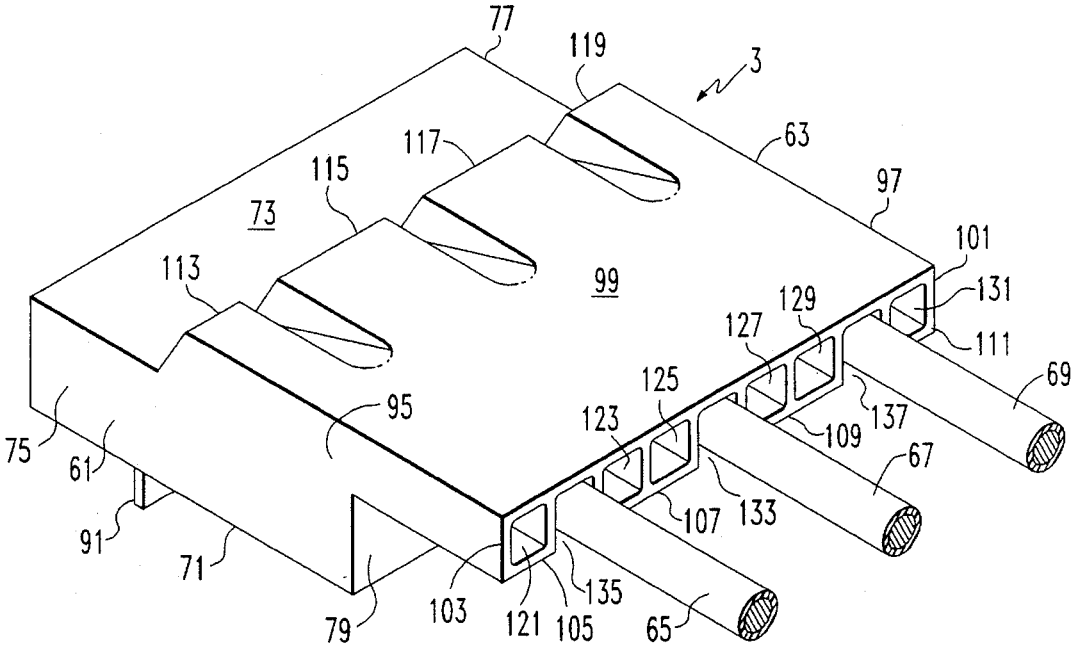
FIG. 3 is a perspective view of the shield structure of FIG. 1.
Figure 4:
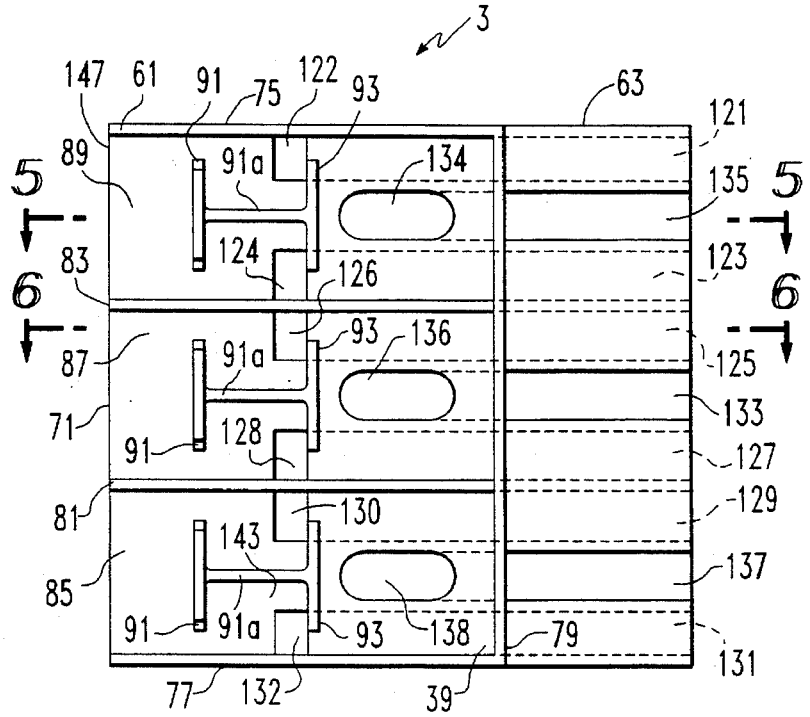
FIG. 4 is a bottom view of the shield structure of FIG. 3 with the cables removed therefrom for clarity purposes.
Figure 7:
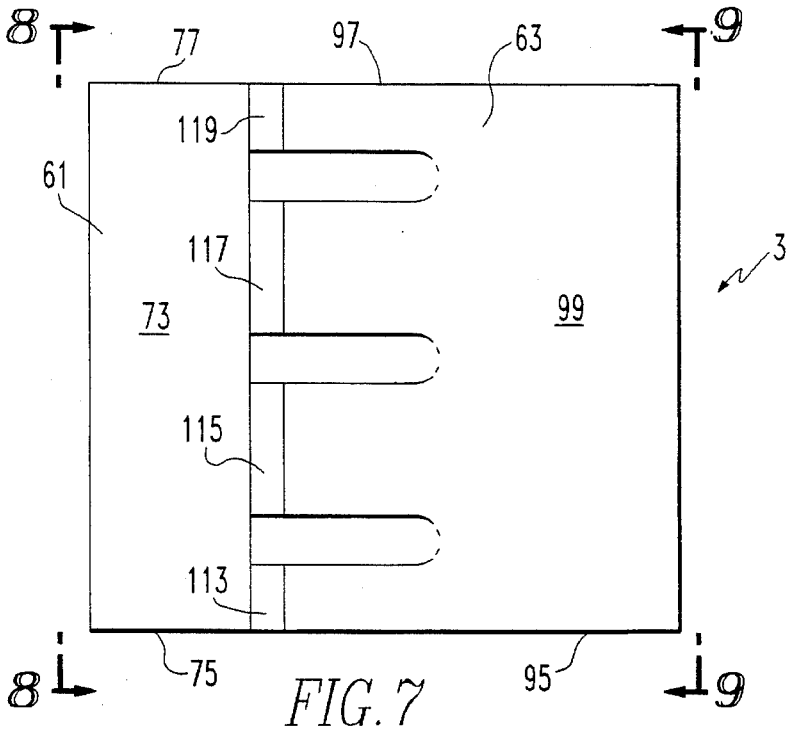
FIG. 7 is a top plan view of the shield structure of FIG. 3.

With particular reference to FIGS. 3 and 4, shield structure 3 is comprised of a main portion 61 and a stepped portion 63, which is integrally formed with main portion 61 and which essentially supports cables 65, 67, and 69.

Main portion 61 has a cavity 71 formed by topwall 73, sidewalls 75 and 77, and rearwall 79. Cavity 71, as particularly shown in FIGS. 4, 8, and 9, contains inner walls 81 and 83, which in conjunction with sidewalls 75 and 77, rearwall 79, and topwall 73 form compartments 85, 87, and 89 which correspond in configuration and number to the pole units 15, 17, and 19 of the three pole circuit breaker 1 of FIGS. 1 and 2.

Each of these compartments 15, 17, and 19 has a barrier member 93 and a lug 91, both hanging from the undersurface 94 of topwall 73 in cavity 71 of main portion 61.

Stepped portion 63, as particularly shown in FIG. 3 includes an overlapping section 95 adjacent to main portion 61 and an overhanging section 97 adjacent to and being an integral part of overlapping section 95.

Stepped portion 63 has topwall 99, sidewalls 101 and 103, bottom wall sections 105, 107, 109 and 111, and slanted front wall sections 113, 115, 117, and 119 which form a transition area between topwall 99 of stepped portion 63, and top wall 73 of main portion 61.

Stepped portion 63 contains a plurality of longitudinal adjacent channels indicated at numerals 121, 123, 125, 127, 129, 131, 133, 135 and 137 which run continuously through the length of overlapping and overhanging sections 95 and 97, respectively, of stepped portion 63. As particularly shown in FIGS. 3 and 4, these channels 121, 123, 125, 127, 129 and 131 are completely enclosed and carry the flow of ionized gases therethrough, while each channel 133, 135 and 137 are partially open on their upper side for receiving and thereafter supporting cables 65, 67, and 69 as shown best in FIG. 3. The dimension of channels 133, 135, and 137 is about equal to that of its respective cable 65, 67, 69 so that cable 65, 69 is wedged therein along the length of stepped portion 63.

Figure 6:
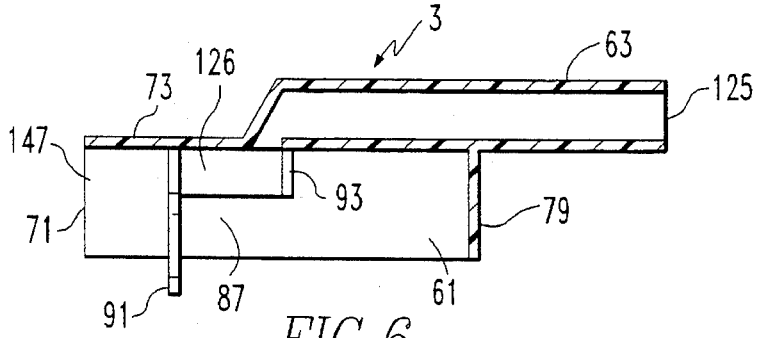
FIG. 6 is a sectional view taken along lines 6—6 of FIG. 4.
Figure 5:
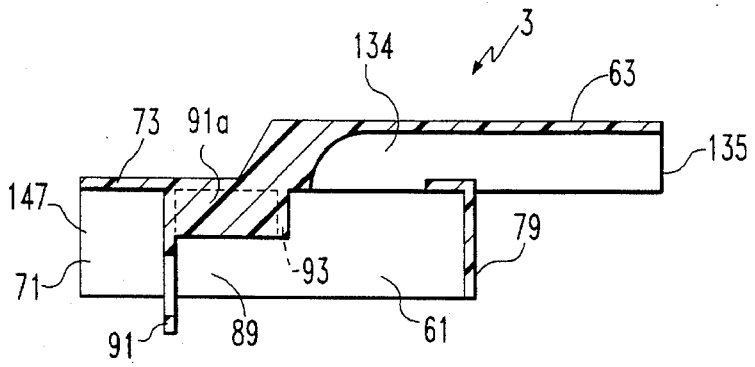
FIG. 5 is a sectional view taken along lines 5—5 of FIG. 4.

With particular reference to FIGS. 4, 5, and 6, each compartment 85, 87, and 89 of main portion 1 contains barrier member 93 and lug 91 interconnected by a web member 91*a*, and as particularly shown in these FIGS. 4, 5 and 6, the entrance 134, 136 and 138, respectively, for the enclosed longitudinal channels 133, 135, and 137 originate to the right of barrier member 93 whereas, the entrance for the enclosed longitudinal channels 121, 123, 125, 127, 129 and 131 originate to the left of barrier member 93. These entrances for longitudinal channels 121 and 123 are indicated by numerals 122 and 124, respectively; that for channels 125 and 127 are indicated by numerals 126 and 128, respectively; and that for channels 129 and 131 are indicated by numerals 130 and 132, respectively.

Both the barrier member 93 and lug 91 cooperate with existing components of the line side 33 of circuit breaker 1 to contain the ionized gases in the area between the barrier member 93 and lug 91 in order to collect and direct the ionized gases up into entrances 122, 124, 126, 128, 130 and 132 and through the enclosed channels 121, 123, 125, 127, 129 and 131. For example, referring to FIGS. 1 and 4, barrier member 93 abuts flexible member 25 mounted on tube 23 of the line terminal assembly 21, and lug 91 abuts the end of tube 23, and cooperate with top wall 16 of circuit breaker 1 to contain the ionized gases in the confined area between barrier member 93 and lug 91 and to separate the wires of cables 65, 67, and 69, as shown for wires 29 of cable 31 in FIG. 1, from the ionized gases and to confine these wires electrically connected to the line terminal assembly 21 in the area between barrier member 93 and rear wall 79 of main portion 61.

As particularly shown in FIG. 5, the entrance 134, 136, and 138 of longitudinal channels 133, 135, and 137 are formed to ease the bend of cables 65, 67, and 69, and thus, lessen the stresses and strain placed on cables 65, 67, and 69, when extending through open-sided channels 133, 135, and 137 of main portion 61 in each compartment 85, 87, and 89. The entrances 122, 124, 126, 128, 130, and 132 and the openings in channels 121, 123, 125, 127, 129 and 132 are such that the ionized gases are allowed to enter these channels and turn and start to expand and dissipate once the gases are in the channels and moving toward the rear of circuit breaker 1.

Channels 121, 123, 125, 127, 129 and 131 for the ionized gases and channels 133, 135, and 137 for supporting cables 65, 67, and 69 by shield structure 3 turn the ionized gases and the cables 65, 67, and 69 at about a 90° angle relative to line side 33 of circuit breaker 1, the result being that the ionized gases are vented toward the rear of circuit breaker 1 and the entrance of the cables into the circuit breaker 1 is from the rear.

Barrier member 93, as discussed hereinabove, cooperates with flexible member 25 mounted on tube 23 shown in FIG. 1 to contain and separate the wires of each cable 65, 67, and 69 connected to its respective line terminal assembly 21 from the ionized gases being directed into enclosed channels 121, 123, 125, 127, 129 and 131 in each respective compartment 85, 87, and 89. Lug 91 and barrier member 93 cooperate with the components of circuit breaker 1 to contain the ionized gases in the area between lug 91 and barrier member 93 and to direct the flow of ionized gases into the enclosed longitudinal channels 121, 123, 125, 127, 129, and 131 and out through the rear of stepped portion 63 away from breaker 1 toward the rear of control center 145 into area 146 where the gases can expand and dissipate.

Figure 8:
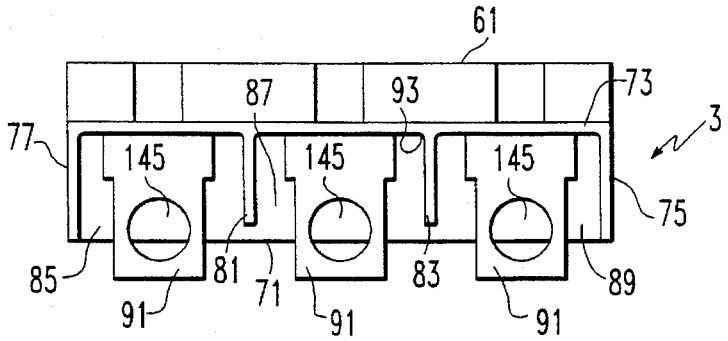
FIG. 8 is an end view taken along lines 8—8 of FIG. 7.
Figure 9:
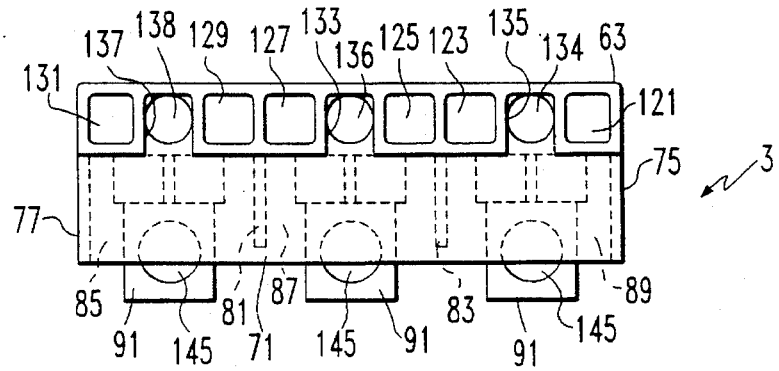
FIG. 9 is an end view taken along lines 9—9 of FIG. 7.
Figure 12:
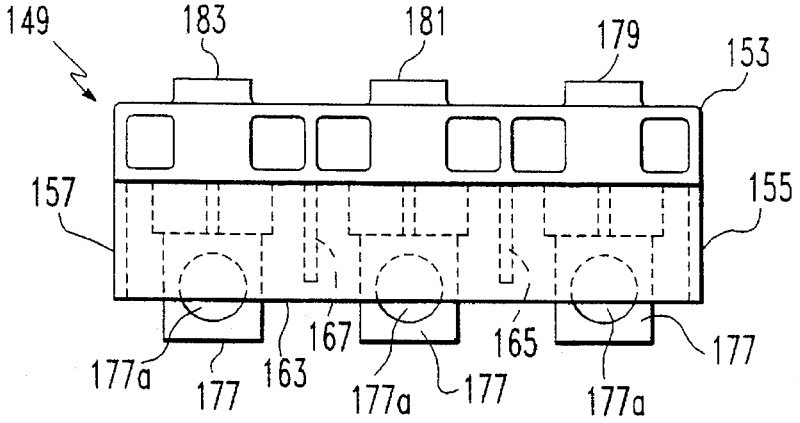
FIG. 12 is an end view taken along lines 12—12 of FIG. 11.

As shown particularly in FIGS. 8 and 9, each lug 91 has an aperture 145, with a diameter generally corresponding to that of tube 23, and which tube 23, in turn, protects screw 27 of the line terminal assembly 21, but which does not inhibit access to screw 27.

When shield structure 3 of FIGS. 1 through 9 is assembled onto circuit breaker 1 of FIGS. 1 and 2, sidewalls 75 and 77 and rearwall 79 of the main portion 61 of shield structure 3 overlap those of circuit breaker on the line side 33 with inner walls 81 and 83 of shield structure 3 being received in the slots 45 and 47 formed by adjacent side walls 41 and 45 of pole units 15, 17, and 19. Each pole unit 15, 17, and 19 is individually enclosed by its respective compartment 85, 87, and 89 of shield structure 3.

Since main portion 61 has an opened wall area indicated at 147 in FIGS. 4–6, top wall 73 of main portion 61 is flush with the front wall 37 of the pole units 15, 17, and 19 of the line side 33 of the circuit breaker 1, as particularly shown in FIG. 1.

Referring again to FIG. 4, enclosed channels 121 and 123 are located on opposite sides of channel 135 which carries cable 65 in compartment 89; enclosed channels 125 and 127 are located on opposite sides of channel 133 carrying cable 67 in compartment 87, and channels 129 and 131 are located on opposite sides of channel 137 carrying cable 69 in compartment 85.

In assembling shield structure 3 over pole units 15, 17, and 19 of circuit breaker 1, sidewalls 75 and 77, and rearwall 79 of shield structure 3 are disposed on the outside of the pole units 15, 17, and 19 where sidewalls 75 and 77 become flush with walls 51 and 53 of the main body of circuit breaker 1 and rear wall 79 of structure 3 abuts top wall 40 of circuit breaker 1 located adjacent to rear wall 39 of units 15, 17, and 19. Inner walls 81 and 83 of structure 3 are tightly snapped into place in slots 45 and 47 formed between the walls of the pole units 15, 17 and 19.

FIGS. 10, 11, 12, 13 and 14 illustrate a second embodiment for a shield structure of the present invention, which shield structure 149 may be substituted for that of the first embodiment of the invention illustrated in FIGS. 1–9. Shield structure 149 may be used in conjunction with the circuit breaker 1 of FIGS. 1 and 2.

Shield structure 149 is similar in construction and operation to the shield structure of FIGS. 3–9 and consists of a main portion 151 and a stepped portion 153 which is integrally formed with main portion 151.

Main portion 151 has a cavity formed by topwall 155, sidewalls 157 and 159, and a rear wall 161. Cavity 163, as particularly shown in FIGS. 12 and 13, contains inner walls 165 and 167, which in conjunction with sidewalls 155 and 157, rearwall 161, and topwall 155 of main portion 15 1 form separate compartments 169, 171, and 173 which correspond in configuration and number to the pole units 15, 17, and 19 of the three pole circuit breaker of FIGS. 1 and 2.

Each of these compartments 169, 171, and 173 has a barrier member 175 and a lug 177 interconnected by a web member 177*b* and hanging from the undersurface of topwall 155 in cavity 163 of main portion 151.

Figure 14:
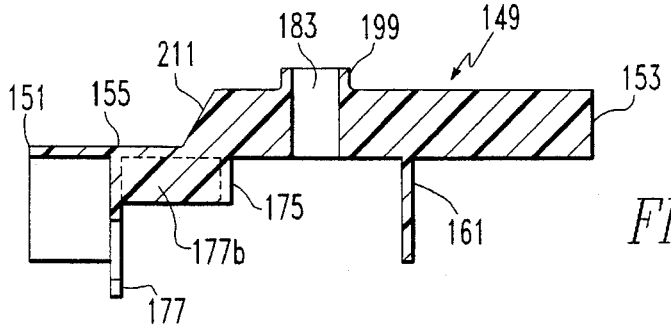
FIG. 14 is a cross-sectional view taken along lines 14—14 of FIG. 13.

Stepped portion 153, as particularly shown in FIG. 14, overlaps and overhangs main portion 151.

Figure 10:
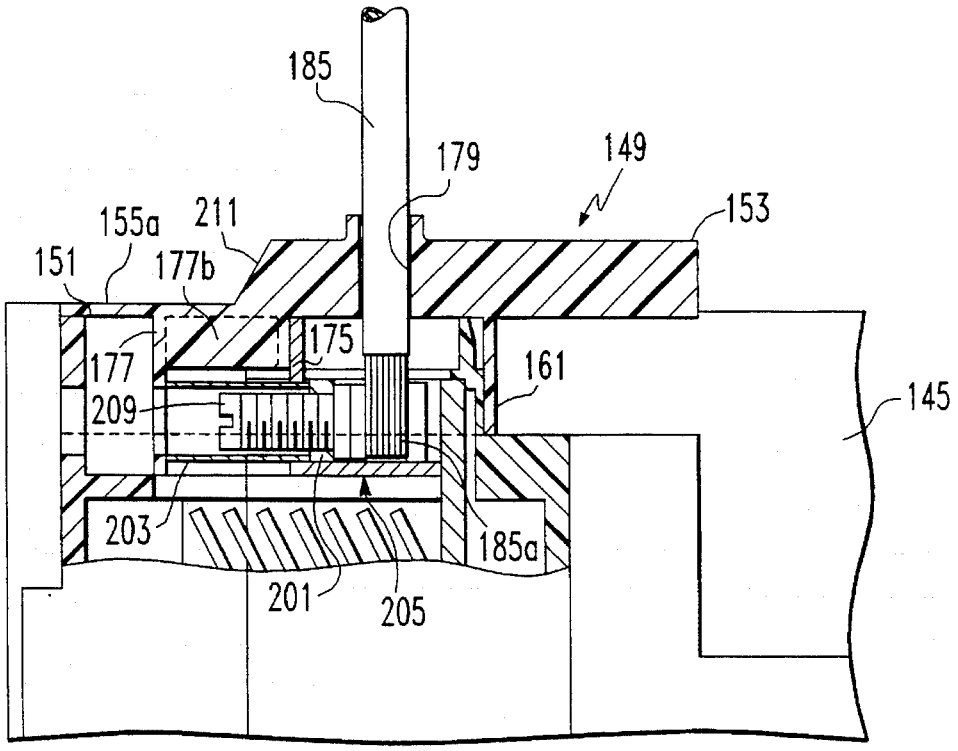
FIG. 10 is a side elevational view, partly cross-sectional view, of a second embodiment of a shield structure of the present invention, mounted on a line side of a circuit breaker which is partly broken away for brevity purposes.

Stepped portion 153 contains a plurality of transverse channels 179, 181, and 183, each for receiving a cable as that shown at 185 in FIG. 10, and longitudinal channels 187, 189, 191, 193, 195, and 197, which are arranged generally perpendicularly to transverse channels 179, 181, and 183 for directing ionized gases to the rear of circuit breaker 1. Transverse channels 179, 181, and 183 each have a collar 199, originate in topwall 155 of main portion 151, and communicate with one of compartments 169, 171, and 173, respectively, in cavity 163 of main portion 151 as particularly shown in FIG. 13.

Figure 13:
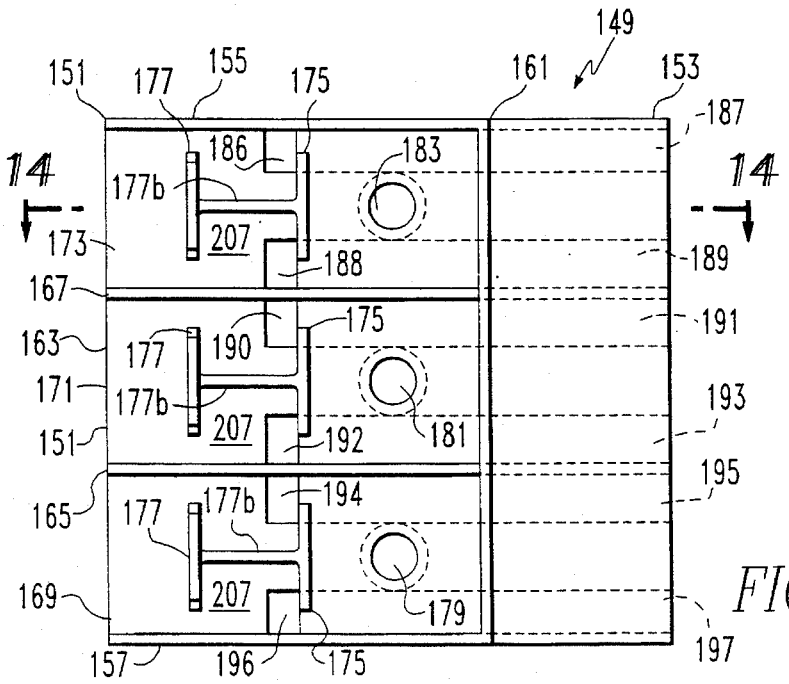
FIG. 13 is a bottom view of the shield structure of FIG. 11.

As shown particularly in FIG. 13, the entrance to each transverse channel 179, 181, and 183 is located to the right side of barrier member 175, with the entrances 186, 188, 190, 192, 194, and 196 to longitudinal channels 187, 189, 191, 193, 195, and 197, respectively, being located adjacent to and on the left side of barrier member 175.

Barrier member 175, as discussed hereinabove, cooperates with flexible member 201 mounted on tube 203 (shown in FIG. 1) to contain and separate the wires 185*a* of cable 185 connected to its respective line terminal assembly 205 from the ionized gases being directed into longitudinal channels 187, 189, 191, 193, 195, and 197 in each respective compartment 169, 171, and 173. As discussed hereinabove, lug 177 and barrier member 175 cooperate with the components of the circuit breaker to contain the ionized gases in the area designated at 207 in FIG. 13 to contain a substantial amount of the ionized gases in this area and to direct the flow of these ionized gases into longitudinal channels 187, 189, 191, 193, 195 and 197 and out through the rear of stepped portion 153 toward the rear of control center 145.

Each lug 177 has an aperture 177a with a diameter corresponding to that of the tube 203, which tube in turn protects the screw 209 of the line terminal assembly in that the lug does not inhibit access to the screw.

As in the shield structure 3 of FIGS. 1 through 9, sidewalls 155 and 157 and rearwall 161 of main portion 151 of structure 149 overlap those of the circuit breaker on the line side 33 with inner walls 165 and 167 of structure 149 being received in the slots 43 and 47 of circuit breaker 1 formed between the adjacent parallel walls of the pole units 15, 17, and 19, on the line side.

Being that main portion 151 is opened between sidewalls 155 and 157 in the area opposite to rearwall 161 when referring to the left of FIGS. 13 and 14, top wall 155*a* of main portion 151 is flushed with the front walls 37 of the pole units 15, 17, and 19 of the line side of circuit breaker 1.

Figure 11:
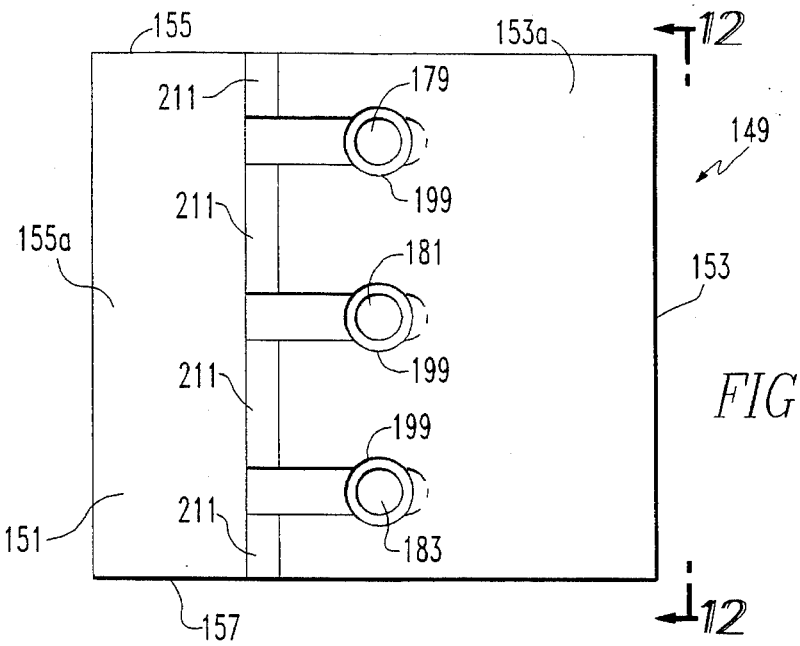
FIG. 11 is a top plan view of the shield structure of FIG. 10 detached from the circuit breaker.

The transition area between top wall 155*a* of main portion 155 and top wall 153*a* of stepped portion 153 includes a slanted wall section indicated at numeral 211 in FIGS. 10, 11 and 14.

As particularly shown in FIG. 13, entrance 186 and 188 of longitudinal channels 187 and 189, respectively, are to the left of barrier member 175, and transverse channel 183 is located in the confined area to the fight of barrier member 175 in compartment 173. The entrance 190 and 192 of longitudinal channels 191 and 193, respectively, are located to the left of barrier member 175, and transverse channel 181 is located in a confined area to the right of barrier member 175 in compartment 171. The entrances 194 and 196 to longitudinal channels 195 and 197, respectively, are located to the left of barrier member 175 and transverse channel 179 is located to the right of barrier member 175 in compartment 169.

In assembling shield structure 149 over the pole units 15, 17, and 19 of circuit breaker 1, sidewalls 155 and 157, and rearwall 161 are arranged on the outside of the pole units 15, 17, and 19, respectively, and become flush with the walls of the main body of the circuit breaker with the inner walls 165 and 167 of structure 149 tightly fitting into slots 45 and 47 formed between the adjacent walls of the pole units 15, 17, and 19.

This construction for shield structure 3 and for shield structure 149 fully encloses the line side of the circuit breaker to resist the buildup of pressure of the ionized gases by providing a receptacle for the ionized gases which sufficiently and effectively receives the ionized gases as quickly as they develop and to direct them immediately to the rear of the circuit breaker, while isolating the wires of the cables electrically connected to the line terminal assemblies.

From the above description of the two embodiments of the present invention, it can be appreciated that the shield structure 3 enables the cables 65, 67, and 69 to enter the line terminal assemblies 21 from the rear of the circuit breaker; whereas shield structure 149 enables the cables 179 to enter the line terminal assemblies 205 from the top of the circuit breaker.

The longitudinal channels 121–137 for carrying the ionized gases and supporting the cables 65, 67, and 69 of the shield structure 3 of FIGS. 1–9, and the longitudinal channels 187, 189, 191, 193, 195, and 197 for carrying the ionized gases of the shield structure 149 of FIGS. 10–14 are directed about 90° relative to the main body of circuit breaker 1 so that a compact unit is provided for the circuit breaker with shield structure 3 or 149 in order to enable a circuit breaker to fit into a confined area of a motor control center 145. Shield structure 3 and 149, may be molded and may be made from a high impact glass reinforced plastic.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit interrupter for an electrical distribution system having a rear area, a line side with line terminal means and cable means connected to a power source, and a load side with load terminal means, comprising:

separable contacts connected in series between said line terminal means and said load terminal means, and which said separable contacts open to interrupt current between said line terminal means and said load terminal means causing arcing which produces ionized gases in said line side, a housing for enclosing said separable contacts and having an interior containing said ionized gases, and external shield structure means communicating with said interior of said housing and mounted on at least said line side of said housing of said circuit interrupter, said shield structure means comprising first channel means extending rearwardly of said circuit interrupter for receiving said ionized gases from said interior of said housing and for directing said ionized gases through said shield structure means and to said rear area of said circuit interrupter.

2. A circuit interrupter of claim 1, wherein said shield structure means further comprises means for supporting said cable means of said line side.

3. A circuit interrupter of claim 2, wherein said shield structure means further comprises barrier means for isolating said cable means of said line side from said ionized gases.

4. A circuit interrupter of claim 2, wherein said means for supporting said cable means of said line side includes second channel means.

5. A circuit interrupter of claim 4, wherein said shield structure means further comprises barrier means located between said first channel means and said second channel means for isolating said cable means in said second channel means on said line side from said ionized gases in said first channel means.

6. A circuit interrupter of claim 4, wherein said shield structure means further comprises a main portion and a stepped portion integrally formed with said main portion and having a top wall and a rear area, and wherein said first channel means for carrying said ionized gases are longitudinal channels along said main portion and said stepped portion to direct said ionized gases out of said rear area of said stepped portion, and wherein said second channel means for supporting said cable means are transverse channels located in said top wall of said stepped portion for leading said cable means out of said line side of said circuit interrupter.

7. A circuit interrupter of claim 4, wherein said shield structure means further comprises a main portion and a stepped portion integrally formed with said main portion; and wherein said first channel means for said directing of said ionized gases to said rear area of said circuit interrupter and said second channel means for said supporting of said cable means extend longitudinally along said main portion and said stepped portion of said shield structure means for said directing of said ionized gases and to direct said cable means to said rear area of said circuit interrupter.

8. A circuit interrupter of claim 7, wherein said main portion has an open cavity formed by sidewalls and a rear wall, and said cavity contains inner walls for forming a plurality of compartments in said main portion, and wherein said first channel means includes a plurality of channels for said ionized gases and said second channel means includes at least one channel for supporting said cable means, and wherein said plurality of channels of said first channel means and said at least one channel of said second channel means originate in each of said plurality of compartments in said cavity of said main portion.

9. A circuit interrupter of claim 8, wherein one of said plurality of channels of said first channel means is disposed on each side of said at least one channel of said second channel means.

10. A circuit interrupter of claim 8, wherein said first channel means for said ionized gases are fully enclosed at least in said stepped portion, and wherein said second channel means for said cable means include an open under side in at least said stepped portion and has a dimension about equal to the diameter of said cable means for wedging said cable means therein for said supporting of said cable means along the length of said stepped portion of said shield structure means.

11. A circuit interrupter of claim 8, said circuit interrupter further comprising a plurality of pole units for said line terminal means on said line side, each of said plurality of said pole units containing said terminal means connected to said cable means and further including tube means adjacent to said terminal means and a flexible member mounted on said tube means.

12. A circuit interrupter of claim 11, wherein said plurality of said pole units are spaced-apart relative to each other, and wherein said each of said plurality of said pole units has side walls, a rear wall, and a front wall for enclosing said each of said plurality of said pole units, and wherein adjacent sidewalls of said plurality of said pole units form slot means therebetween, and wherein said sidewalls, said rear wall, and said inner walls of said main portion of said shield structure means overlap said sidewalls, said rear wall, and said front wall of said plurality of said pole units in a manner said inner walls of said main portion of said shield structure means are disposed in said slot means, and said each of said plurality of said pole units of said circuit interrupter are in communication with one of each of said plurality of compartments in said main portion of said shield structure means.

13. A circuit interrupter of claim 11, wherein said undersurface of said main portion of said shield structure means further includes lug means depending from said undersurface thereof, and disposed adjacent to said tube means in a manner to contain said ionized gases in an area containing said first channel means, and wherein said undersurface of said main portion further includes barrier means disposed between said first channel means for said ionized gases and said second channel means for said cable means and cooperating with said flexible member mounted on said tube means to contain said ionized gases in said area containing said first channel means.

14. A device used in conjunction with a circuit interrupter having an interior, a rear area, a line side, and cable means electrically connected to terminal means on said line side of said circuit interrupter and which said circuit interrupter experiences a current interruption, ultimately resulting in the formation of ionized gases in said interior of said circuit interrupter, said device comprising:

shield structure means communicating with said interior of said circuit interrupter and mounted on at least said line side of said circuit interrupter and comprising first channel means extending rearwardly of said circuit interrupter for directing said ionized gases through said shield structure means and to said rear area of said circuit interrupter.

15. A device of claim 14, wherein said shield structure means further comprises means for supporting said cable means of said line side.

16. A device of claim 14, wherein said shield structure means further comprises barrier means for isolating said cable means of said line side from said ionized gases.

17. A device of claim 15, wherein said means for supporting said cable means of said line terminal side includes second channel means.

18. A device of claim 17, wherein said first channel means and said second channel means are longitudinal channels.

19. A device of claim 17, wherein said first channel means are longitudinal channels and said second channel means are transverse channels.

20. A device of claim 17, wherein said shield structure means further comprises a main portion and a stepped portion integrally formed with said main portion, and wherein said first channel means for said ionized gases and said second channel means for said cable means extend longitudinally along said main portion and said stepped portion for said directing of said ionized gases and to direct said cable means to said rear area of said circuit interrupter.

21. A device of claim 20, wherein said main portion has an open undersurface with sidewalls, a rear wall, and inner walls depending from said undersurface for forming a plurality of compartments in said main portion, and wherein said first channel means includes a plurality of channels for said ionized gases and said second channel means includes at least one channel for supporting said cable means, and wherein said plurality of channels of said first channel means and said at least one channel of said second channel means are located in each of said plurality of compartments in said undersurface of said main portion.

22. A device of claim 21, wherein one of said plurality of channels of said first channel means is disposed on each side of said at least one channel of said second channel means.

23. A device of claim 21, wherein said first channel means for said ionized gases are fully enclosed at least in said stepped portion, and wherein said second channel means for said cable means include an open underside in at least said stepped portion and having a dimension about equal to the diameter of said cable means for wedging said cable means therein for said supporting of said cable means along the length of said stepped portion of said shield structure means.

24. A circuit interrupter for an electrical distribution system having a line side with line terminal means and cable means connected to a power source, and a load side with load terminal means, comprising:

separable contacts connected in series between said line terminal means and said load terminal means, and which said separable contacts open to interrupt current between said line terminal means and said load terminal means causing arcing which produces ionized gases in said line side, a housing for enclosing said separable contacts and said ionized gases and having an interior containing said ionized gases, and shield structure means communicating with said interior of said housing and mounted on at least said line side of said housing of said circuit interrupter and comprising means for receiving and carrying said ionized gases away from said line side, means for supporting said cable means of said line side, and barrier means for isolating said cable means of said line side from said ionized gases.

* * * * *